US011649582B2

(12) United States Patent
Yoon et al.

(10) Patent No.: US 11,649,582 B2
(45) Date of Patent: May 16, 2023

(54) LAUNDRY DRYER

(71) Applicant: LG Electronics Inc., Seoul (KR)

(72) Inventors: Juhan Yoon, Seoul (KR); Soowon Park, Seoul (KR); Manseok Lee, Seoul (KR); Jun Shin, Seoul (KR)

(73) Assignee: LG Electronics Inc., Seoul (KR)

( * ) Notice: Subject to any disclaimer, the term of this patent is extended or adjusted under 35 U.S.C. 154(b) by 116 days.

(21) Appl. No.: 17/192,273

(22) Filed: Mar. 4, 2021

(65) Prior Publication Data

US 2021/0277583 A1 Sep. 9, 2021

(30) Foreign Application Priority Data

Mar. 4, 2020 (KR) ..... 10-2020-0026953

(51) Int. Cl.

| | |
|---|---|
| ***D06F 58/20*** | (2006.01) |
| ***D06F 58/44*** | (2020.01) |
| ***D06F 103/62*** | (2020.01) |
| *D06F 105/58* | (2020.01) |

(52) U.S. Cl.

CPC ..... *D06F 58/203* (2013.01); *D06F 58/44* (2020.02); *D06F 2103/62* (2020.02); *D06F 2105/58* (2020.02)

(58) Field of Classification Search

CPC .... D06F 58/203; D06F 58/44; D06F 2103/62; D06F 2105/58; D06F 39/008; D06F 58/04; D06F 58/20; D06F 58/12; D06F 2105/30

See application file for complete search history.

(56) References Cited

U.S. PATENT DOCUMENTS

| | | | | |
|---|---|---|---|---|
| 9,938,657 | B2 * | 4/2018 | Yoon | D06F 58/24 |
| 2009/0265953 | A1 * | 10/2009 | Bae | D06F 58/30 34/497 |

FOREIGN PATENT DOCUMENTS

| | | |
|---|---|---|
| CN | 101466887 | 6/2009 |
| EP | 1936023 | 6/2008 |
| EP | 2568074 | 3/2013 |
| WO | WO2007145451 | 12/2007 |
| WO | WO2008013426 | 1/2008 |

OTHER PUBLICATIONS

Extended European Search Report in European Appln. No. 21159852.9, dated Sep. 6, 2021, 8 pages.

Office Action in Chinese Appln. No. 202110239261.9, dated Nov. 11, 2022, 8 pages (with English translation).

* cited by examiner

*Primary Examiner* — Jessica Yuen

(74) *Attorney, Agent, or Firm* — Fish & Richardson P.C.

(57) ABSTRACT

A laundry dryer includes: a cabinet defining an outer body of the laundry dryer, a drum that is rotatably disposed inside the cabinet and that is configured to receive hot air and steam, a steam unit that is disposed inside the cabinet and that is configured to generate the steam, a storage tank that is configured to detachably couple to an inside of the cabinet and that defines a storage space for receiving water to be supplied to the steam unit, and a tank housing that is disposed inside the cabinet and that is configured to accommodate the storage tank. An intake hole is defined at a front upper surface of the storage tank and provides, based on the storage tank being accommodated in the tank housing, an air flow path between the storage space and an external space of the storage tank.

20 Claims, 10 Drawing Sheets

LAUNDRY DRYER

CROSS-REFERENCE TO RELATED APPLICATION

This application claims the benefit of Korean Patent Application No. 10-2020-0026953, filed on Mar. 4, 2020, the disclosure of which is hereby incorporated by reference as if fully set forth herein.

TECHNICAL FIELD

The present invention relates to a laundry dryer, and more particularly, capable of reducing a load of a supply pump to supply water to a steam unit and maintaining smooth water supply by forming an intake hole in a storage tank for storing water for steam generation and maintaining an internal air pressure of the storage tank and an external air pressure equally when water is supplied to the steam unit through the supply pump.

BACKGROUND

A laundry dryer removes the moisture from damp laundry to be dried by supplying hot air into a drum while the laundry to be dried such as clothes or bedding is put into a rotating drum.

The hot air supplied into the drum is generated by combustion heat using electric resistance heat or gaseous fuel, or by a condenser constituting a heat pump cycle, and the hot air thus generated is supplied to the inside of the drum by a circulation fan.

The moisture of the laundry to be dried is evaporated from the drum, and the air vented from the drum retains the moisture of the object to be dried, resulting in a high temperature and high humidity state. The type of dryer is classified into a condenser type and a vented type according to a method of treating the hot and humid air.

The condenser type laundry dryer does not discharge hot and humid air to an outside, but condenses the moisture contained in the hot and humid air through heat exchange while circulating inside the dryer. In contrast, the vented type laundry dryer directly discharges the hot and humid air to the outside. The condenser type laundry dryer has a structure for treating condensed water, and the vented type laundry dryer has a structure for venting air.

On the other hand, in recent years, in order to improve the drying efficiency of laundry, or for sterilization of laundry to be dried and sterilization of the drum itself, a laundry dryer having a means for spraying steam into the drum has been developed.

The steam jet type laundry dryer is configured to receive water for steam generation directly from an external water supply source or from a storage tank installed inside the laundry dryer.

In the case of using a storage tank to supply water to a steam unit, when the water stored in the storage tank is exhausted, a user separates the storage tank from the laundry dryer, recharges the water and installs the storage tank in the laundry dryer again. Accordingly, the water replenishment for the steam product is made.

In this regard, Korean Laid-Open Patent Publication No. 10-2008-0056500 proposes a cartridge-type internal storage tank including a lower housing having a water storage space therein and an upper housing detachably attached to the lower housing.

However, in the configuration disclosed in the literature, since the upper housing is detachably attached to the lower housing, the internal storage space is not completely sealed, so that there is a problem of a high possibility of leakage between the lower housing and the upper housing by the vibration generated when a drum rotates or in the process of transporting the internal water storage tank in a state in which water is replenished from an outside.

In addition, since separate intake holes are not provided in the upper housing and the lower housing, the air pressure inside the water storage tank gradually decreases when the water inside the water storage tank is forcibly supplied to the steam unit through a pump.

As a result, the load of the pump required for forcibly supplying water is gradually increased, making it difficult to smoothly supply water to the steam unit, thereby causing a problem in that the entire steam supplying process may be delayed.

(Patent document 0001) Korean Laid-Open Patent Publication No. 10-2008-0056500

SUMMARY

The present invention has been conceived to solve the above-described problems, and provides a laundry dryer with a significantly lowered possibility of leakage between a tank body and a tank cover by fastening the tank cover constituting a storage tank for storing water to be supplied to a steam unit to the tank body in a fusion method.

In addition, the present invention provides a laundry dryer capable of reducing the load of a supply pump to supply water to a steam unit and maintaining smooth water supply by forming an intake hole on the upper side surface of a storage tank and maintaining an internal air pressure of the storage tank and an external air pressure equally when water is supplied to the steam unit through the supply pump.

According to the present invention, a laundry dryer may include a cabinet forming an outer body, a drum rotatably supported inside the cabinet and supplied with hot air and steam therein, a steam unit placed inside the cabinet and to generate the steam, a storage tank placed inside the cabinet and to include a storage space for storing water to be supplied to the steam unit therein and a tank housing placed inside the cabinet and to accommodate the storage tank. An intake hole for communicating the storage space and an external space of the storage tank may be formed on a front upper side surface of the storage tank based on a state in which the storage tank is accommodated in the tank housing.

In addition, the laundry dryer may further include a supply pump placed between the steam unit and the storage tank and to transfer water stored in the storage tank to the steam unit. The air from the external space may be sucked into the storage space through the intake hole when the supply pump is operated.

In addition, the storage tank may include a box-shaped tank body with an open upper side surface and having the storage space therein, a tank cover coupled to the open upper side surface of the tank body and a decorative cover attached to an upper side surface of the tank cover and placed to at least partially cover the upper side surface of the tank cover. The intake hole may include a first intake hole extending through the decorative cover and a second intake hole extending through the tank cover.

In addition, the storage tank further may include a handle unit having a first concave surface formed by concave from the tank cover toward the storage space, and a second concave surface formed by concave from the decorative cover toward the first concave surface. The first concave surface may be formed close to a front edge of the tank cover and the second concave surface may be formed close to a front edge of the decorative cover so that a front side of the storage tank can be gripped.

In addition, the first intake hole may be formed between the front edge of the decorative cover and the second concave surface, and the second intake hole may be formed between the first concave surface and a side edge of the tank cover and at a position close to the front edge of the tank cover.

In addition, a user can hold the handle unit to separate the storage tank from the tank housing. The first intake hole and the second intake hole may be positioned higher than the second concave surface in the direction of gravity in a state in which the tank housing is separated and the handle is gripped.

In addition, the front edge and side edge of the tank cover may be fused to the upper end of the tank body to form a fused portion, and the second intake hole may be configured to be formed to avoid the fusion portion.

In addition, the first intake hole may include a first inlet formed on an upper side surface of the decorative cover and a first outlet formed on a lower side surface of the decorative cover. The second intake hole may include a second inlet formed on the upper side surface of the tank cover and a second outlet formed on a lower side surface of the tank cover. The first outlet and the second inlet may be directly connected so that the first outlet and the second inlet overlap at least partially.

In addition, the first outlet and the second inlet may be all overlapped.

In addition, the first outlet and the second inlet may be each having a circular shape having the same diameter.

In addition, the first outlet and the second inlet each may have a circular shape having a different diameter, and a diameter of the first outlet may be smaller than a diameter of the second inlet.

In addition, the tank cover may include a cylindric-shaped first engaging protrusion having a shape surrounding the second inlet and protruding from the upper side surface of the tank cover toward the first outlet. The decorative cover may include a ring-shaped second engaging protrusion having a shape surrounding the first outlet and protruding from the lower side surface of the decorative cover toward the second inlet. When the decorative cover is attached to the tank cover, the cylindric-shaped first engaging protrusion may be inserted into an inside of the ring-shaped second engaging protrusion.

In addition, an outer circumferential surface of the cylindric-shaped first engaging protrusion and an inner circumferential surface of the ring-shaped second engaging protrusion may be in close contact with each other over a circumferential direction.

In addition, the storage tank may further include an intake valve to open and close the second outlet of the second intake hole.

In addition, the intake valve may include a reed valve body having one end that becomes a fixed end attached to the lower side surface of the tank cover and the other end that becomes a free end to open and close the second outlet. When the supply pump is operated, the free end of the reed valve body may be separated from the first outlet by an air pressure difference between the storage space and the external space.

In addition, the first intake hole may include a first inlet formed on an upper side surface of the decorative cover and a first outlet formed on a lower side surface of the decorative cover. The second intake hole may include a second inlet formed on the upper side surface of the tank cover and a second outlet formed on a lower side surface of the tank cover. The first outlet and the second inlet may do not overlap each other.

In addition, the tank cover may further include an insertion boss protruding from the upper side surface of the tank cover to be inserted into an inside of the first intake hole. The decorative cover may further include a plurality of guide ribs protruding from an inner circumferential surface of the first intake hole toward the inside of the first intake hole and extending linearly from the first inlet to the first outlet.

In addition, each of the first inlet and the first outlet may have a circular shape having a different diameter, and the first inlet may have a smaller diameter than that of the first outlet.

In addition, the inner circumferential surface of the first intake hole may have a truncated cone shape in which a cross-sectional area gradually expands while proceeding from the first inlet to the first outlet.

In addition, the tank cover may further include a blocking wall portion extending from the upper side surface of the tank cover toward the lower side surface of the decorative cover so as to surround the second inlet of the second intake hole and the insertion boss. An upper surface of the blocking wall portion may be in close contact with the lower side surface of the decorative cover while surrounding the first outlet of the first intake hole.

The laundry dryer according to the present invention can remarkably reduce the possibility of leakage of water between a tank body and a tank cover by fastening the tank cover constituting a storage tank for storing the water to be supplied to a steam unit to the tank body in a fusion method.

In addition, the laundry dryer according to the present invention can reduce the load of a supply pump to supply water to a steam unit and maintain smooth water supply by forming an intake hole on the upper side surface of a storage tank and maintaining an internal air pressure of the storage tank and an external air pressure equally when water is supplied to the steam unit through the supply pump.

DETAILED DESCRIPTION

Figure 1:
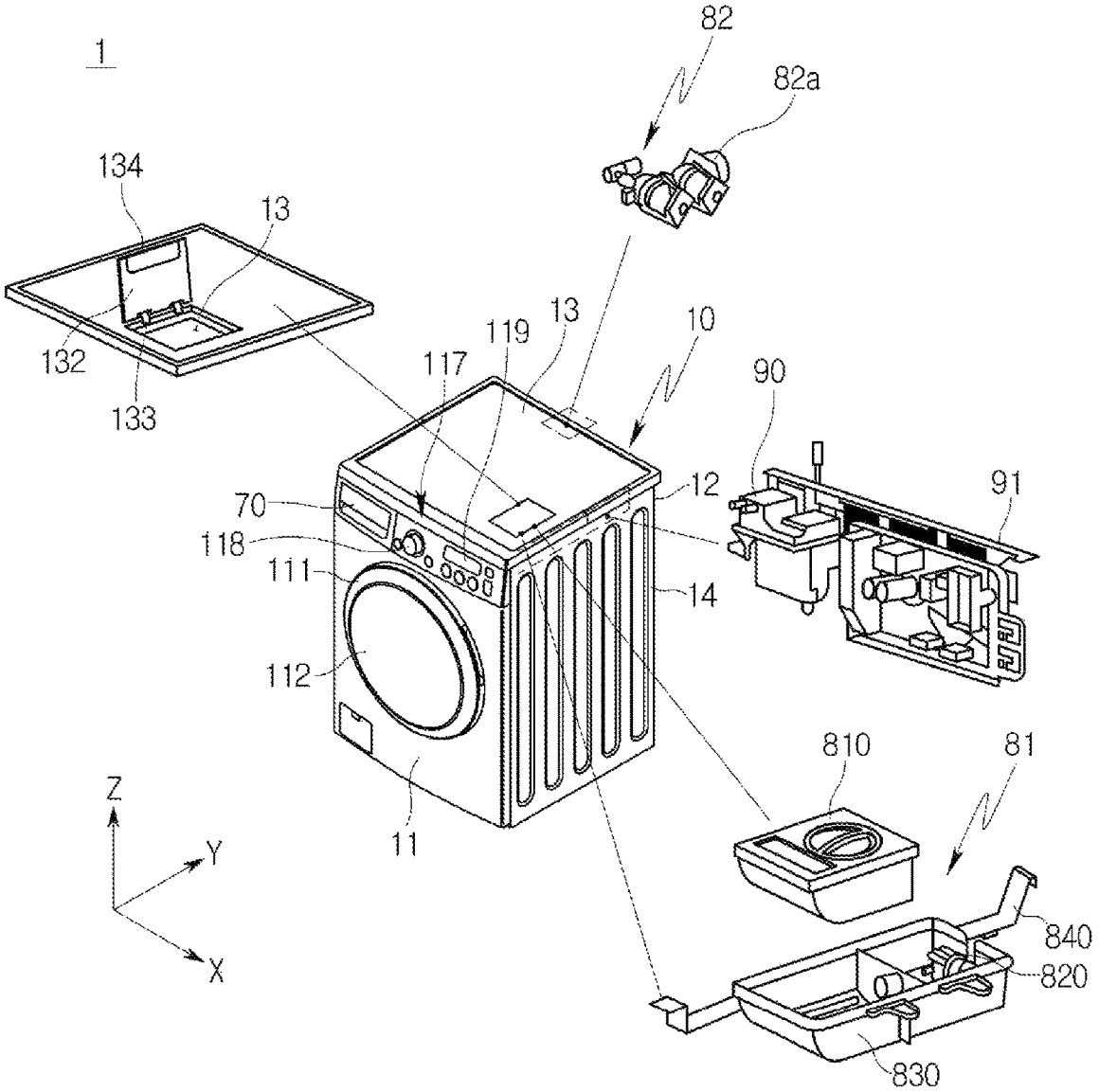
FIG. 1 is a schematic diagram showing a basic configuration of a laundry dryer according to the present invention.

Hereinafter, preferred embodiments of the present invention will be described in detail with reference to the accompanying drawings.

In the present invention, various modifications may be made and various embodiments may be provided, and specific embodiments will be illustrated in the drawings and described in detail in the detailed description. This is not intended to limit the present invention to a specific embodiment, and should be construed as including all changes, equivalents, and substitutes included in the spirit and scope of the present invention.

In describing the present invention, terms such as first and second may be used to describe various elements, but the elements may not be limited by terms. The terms are only for the purpose of distinguishing one component from another component. For example, without departing from the scope of the present invention, a first component may be referred to as a second component, and similarly, a second component may be referred to as a first component.

The term "and/or" includes a combination of a plurality of related described items or any of a plurality of related described items.

When a component is referred to as being "connected" or "contacted" to another component, it may be understood that it may be directly connected or contacted to the other component, but other components may exist in the middle. On the other hand, when a component is referred to as being "directly connected" or "directly contacted" to another component, it may be understood that there is no other component in the middle.

The terms used in the present application are only used to describe specific embodiments, and are not intended to limit the present invention. Singular expressions include plural expressions unless the context clearly indicates otherwise.

In the present application, terms such as "comprise" or "have" are intended to designate the existence of features, numbers, steps, actions, components, parts or a combination thereof described in the specification, and it may be understood that the possibility of the presence or addition of one or more other features or numbers, steps, actions, components, parts, or combinations thereof, is not preliminarily excluded.

Unless otherwise defined, all terms used herein including technical or scientific terms may have the same meaning as commonly understood by one of ordinary skill in the art to which the present invention belongs. Terms as defined in a commonly used dictionary may be interpreted as having a meaning consistent with the meaning in the context of the related technology, and unless explicitly defined in this application, it may not be interpreted as an ideal or excessively formal meaning.

In addition, the following embodiments are provided to more completely describe to those with average knowledge in the art, and the shapes and sizes of elements in the drawings may be exaggerated for clearer explanation.

Figure 2:
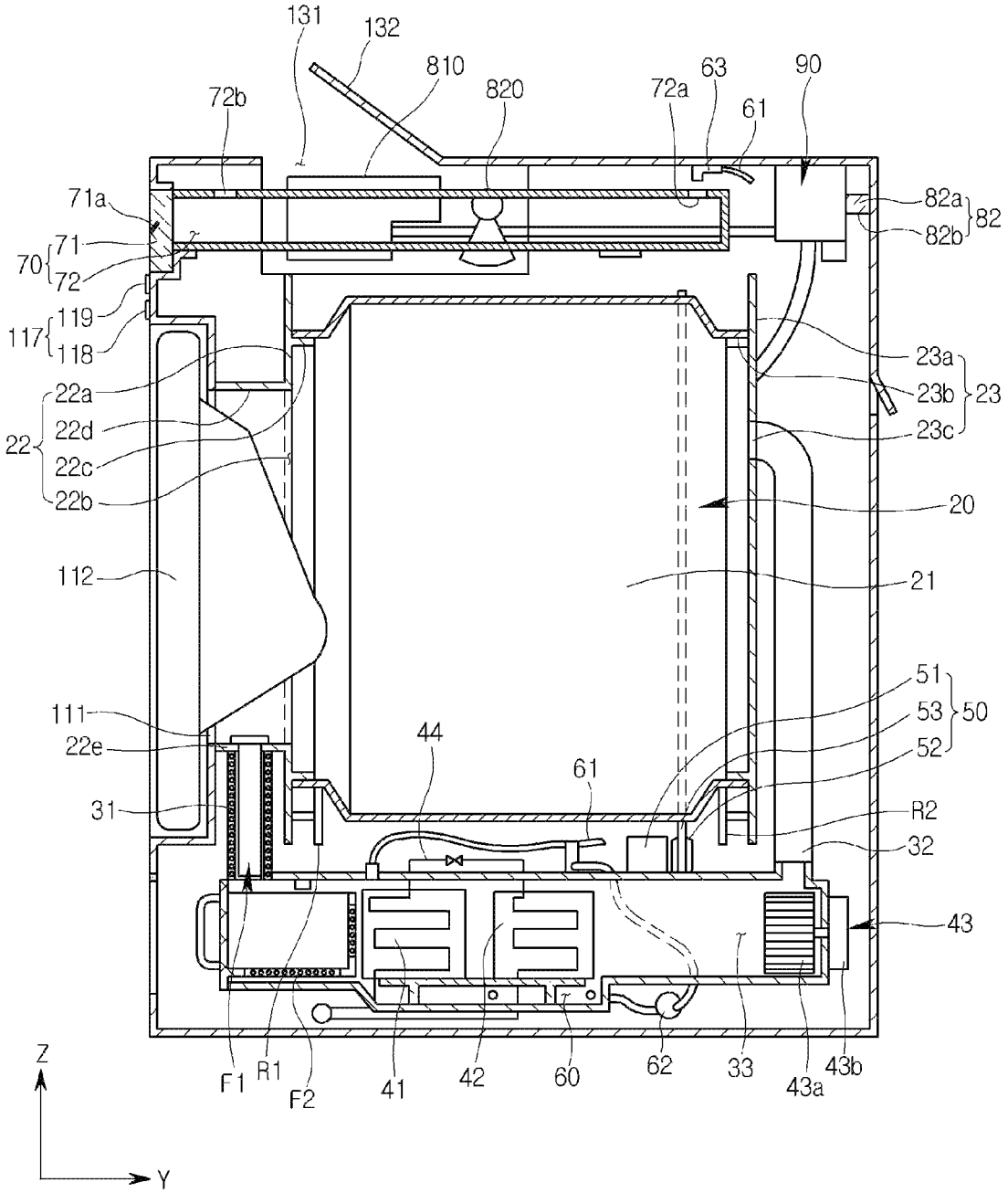
FIG. 2 is a cross-sectional view of FIG. 1.

FIG. 1 is a schematic diagram showing a basic configuration of a laundry dryer according to the present invention, and FIG. 2 is a cross-sectional view of FIG. 1.

As shown in FIGS. 1 and 2, a cabinet 10 forming an outer body of a laundry dryer 1 may include a front panel 11 constituting a front surface, a rear panel 12 constituting a rear surface, a pair of side panels 14 constituting side surfaces and an upper panel 13 constituting an upper surface of the laundry dryer 1.

The front panel 11 may be provided with an inlet 111 configured to communicate with a drum 20, which will be described later, and a door 112 rotatably coupled to the cabinet 10 to open and close the inlet 111.

A control panel 117 may be provided on the front panel 11.

The control panel 117 may be installed with an input unit 118 to receive a control command from a user, a display unit 119 to display information such as a control command selectable by a user and a main control unit (not shown) to control an operation command of the laundry dryer 1.

Meanwhile, the input unit 118 may be configured to include a power supply request unit to request power supply to the laundry dryer, a course input unit to allow a user to select a desired course among a plurality of courses and an execution request unit to request the start of the course selected by the user, and the like.

The display unit 119 may be configured to include at least one of a display panel to display characters and/or figures and a speaker to output an audio signal and a sound. A user can easily identify a current operation status and a remaining time by using the output information of the display unit 119.

The cabinet may include the drum 20 which is rotatably provided inside the cabinet 10 and provides a space for accommodating clothes, a duct unit 30 forming a flow path for resupplying the air discharged from the drum 20 to the drum 20 and a heat exchange unit 40 which dehumidifies and heats the air introduced into the duct unit 30 and then resupplies it to the drum 20.

The drum 20 may include a cylindrical drum body 21 with an open front surface. A first support unit 22 rotatably supporting the front surface of the drum body 21 and a second support unit 23 rotatably supporting the rear surface of the drum body 21 may be provided inside the cabinet 10.

The first support unit 22 may be configured to include a first fixing body 22*a* fixed to the inside of the cabinet 10, a drum inlet 22*b* passing through the first fixing body 22*a* and communicating the inlet 111 and the inside of the drum body 21 and a first support body 22*c* provided in the first fixing body 22*a* and inserted into the front surface of the drum body 21.

The first support unit 22 may be configured to further include a connection body 22*d* connecting the inlet 111 and the drum inlet 22*b*. As shown, the connection body 22*d* may be provided in a pipe shape extending from the drum inlet 22*b* toward the inlet 111. In addition, the connection body 22*d* may be provided with an air outlet 22*e* communicating with the duct unit 30.

As shown in FIG. 2, the air outlet 22*e* may be a passage that allows the internal air of the drum body 21 to move to the duct unit 30, and include a through hole penetrating the connection body 22*d*.

The second support unit 23 may be configured to include a second fixing body 23*a* fixed inside the cabinet 10 and a second support body 23*b* provided on the second fixing body 23*a* and inserted into the rear surface of the drum body 21.

The second support unit 23 may be provided with an air inlet 23*c* penetrating the second fixing body 23*a* and communicating the inside of the drum body 21 with the inside of the cabinet 10.

In this case, the duct unit 30 may be configured to connect the air outlet 22*e* and the air inlet 23*c*.

The drum body 21 in a cylindrical shape may rotate by various types of a driving unit 50.

For example, the driving unit 50 according to one embodiment, as shown in FIG. 2, may include a motor 51 fixed inside the cabinet 10, a pulley 52 rotated by the motor 51 and a belt 53 connecting the circumferential surface of the pulley 52 and the circumferential surface of the drum body 21.

In this case, the first support unit 22 may be provided with a first roller R1 rotatably supporting the circumferential surface of the drum body 21, and the second support unit 23 may be provided with a second roller R2 rotatably supporting the circumferential surface of the drum body 21.

However, the present invention is not limited thereto, and a direct driven driving unit in which the motor 51 is directly connected to the drum to rotate the drum without passing through a pulley and a belt may also be applicable, which naturally falls within the scope of the present invention. For convenience, the following description will be made based on the illustrated embodiment of the driving unit 50.

The duct unit 30 may include an exhaust duct 31 connected to the air outlet 22*e*, a supply duct 32 connected to the air inlet 23*c* and a connection duct 33 connecting the exhaust duct 31 and the supply duct 32 and having the heat exchange unit 40 installed inside therein.

The heat exchange unit 40 may be provided with various devices capable of sequentially performing dehumidification and heating of the air introduced into the duct unit 30. For example, the heat exchange unit 40 may be provided as a heat pump system.

As a heat pump system, the heat exchange unit 40 may include a circulation fan 43 to move air along the duct unit 30, a first heat exchanger (a heat absorbing unit) 41 to perform dehumidifying function by lowering the humidity of the air introduced into the duct unit 30 and a second heat exchanger (a heating unit) 42 provided inside the duct unit 30 to heat the air that has passed through the first heat exchanger 41.

The circulation fan 43 may be configured to include an impeller 43*a* provided in the duct unit 30 and an impeller motor 43*b* to rotate the impeller 43*a*.

The impeller 43*a* may be installed at any position among the exhaust duct 31, the connection duct 33 and the supply duct 32. In the embodiment shown in FIG. 2, the impeller 43*a* is provided on the connection duct 32, but the present invention is not limited thereto. For convenience hereinafter, it is described the embodiment in which the impeller 43*a* is provided in the connection duct 32.

The heat absorbing unit 41 and the heating unit 42 may be sequentially arranged along the direction from the exhaust duct 31 to the supply duct 32 in the connection duct 33, and connected to each other through a refrigerant pipe 44 forming a circulation flow path of the refrigerant.

The heat absorbing unit 41 may cool the air and evaporate the refrigerant by transferring the heat of the air introduced into the exhaust duct 31 to the refrigerant.

The heating unit 42 may heat the air and condense the refrigerant by transferring the heat of the refrigerant passing through a compressor 45 to the air.

In this case, when the moisture contained in the air passes through the heat absorbing unit 41, it moves along the surface of the heat absorbing unit 41 and collects on the bottom surface of the connection duct 33.

As described above, a configuration already known in the art may be adopted as the configuration of the heat exchange unit 40 of the heat pump system having the heat absorbing unit 41 and the heating unit 42, and detailed configurations related thereto will be omitted.

On the other hand, in order to collect the condensed water that is condensed from the air passing through the heat absorbing unit 41 and collected on the bottom surface of the connection duct 33, the laundry dryer 1 according to the present invention may be provided with a water collecting unit 60.

The condensed water condensed in the heat absorbing unit 41 may be first collected in the water collecting unit 60 and then secondly collected in the water storage unit 70. The water collecting unit 60 may be located inside the connection duct 33 as shown, or may be separately provided in a space spaced apart from the connection duct 33.

The condensed water first collected through the water collecting unit 60 may be supplied to the water storage unit 70 through the condensate water supply pipe 61. In this case, the condensate water supply pipe 61 may be provided with a condensate pump 62 to smoothly discharge the condensed water.

The water storage unit 70 may be configured to include a water storage tank 72 provided to be withdrawn from one side of the front panel 11 to an outside. The water storage tank 72 may be configured to collect the condensed water delivered from the water collecting unit 60, which will be described later.

A user can remove the condensed water by drawing out the water storage tank 72 from the cabinet 10 and then mount it in the cabinet 10 again. Accordingly, the laundry dryer according to the present invention may be disposed at any place where a sewer or the like is not installed.

In more detail, the water storage unit 70 may be configured to include the water storage tank 72 detachably provided in the cabinet 10 to provide a space for storing water and an inlet 72*a* provided to pass through the water storage tank 72 to introduce the water discharged from condensate water supply pipe 61 into the water storage tank 72.

The water storage tank 72 may be provided as a drawer-type tank drawn out from the cabinet 10. In this case, the front panel 11 of the cabinet may be provided with a reservoir mounting hole into which the water storage tank 72 is inserted.

A panel 71 may be fixed to the front surface of the water storage tank 72, and the panel 71 may be provided to form a part of the front panel 11 by detachably coupling it to the reservoir mounting hole.

The panel 71 may further include a groove portion 71*a* into which a user's hand is inserted and gripped. In this case, the panel 71 may also serve as a handle for drawing the water storage tank 72 out of the cabinet or inserting it into the cabinet.

The inlet 72*a* may be formed to receive the condensed water discharged from a condensate nozzle 63 fixed to the cabinet 10. The condensate nozzle 63 may be fixed to the upper panel 13 of the cabinet 10 so that the water storage tank 72 is positioned above the inlet 72*a* when the water storage tank 72 is inserted into the cabinet 10.

A user can dispose of the water inside the water storage tank 72 by turning or tilting the water storage tank 72 toward the direction in which the inlet 72*a* is located after withdrawing the water storage tank 72 from the cabinet 10. A communication hole 72*b* may be further provided to penetrate the upper surface of the water storage tank 72 so that the water inside the water storage tank 72 can be easily discharged through the inlet 72*a*.

In addition, the laundry dryer 1 according to the present invention may include a first filter unit F1 and a second filter unit F2 as a means for removing foreign substances such as lint or dust generated during the drying process of laundry such as clothes.

The first filter unit F1 may be provided in the exhaust duct 31 to primarily filter foreign substances contained in the air discharged from the drum 20.

The second filter unit F2 may be placed downstream of the first filter unit F1 in the flow direction of the air so that the foreign substances contained in the air passing through the first filter unit F1 can be secondarily filtered. In more detail, as shown, the second filter unit F2 may be preferably placed on the upstream side of the first heat exchanger 41 in the connection duct 33. This can prevent the foreign substance contained in the air from accumulating in the first heat exchanger 41 acting as a heat absorbing unit and contaminating the first heat exchanger 41 or causing performance degradation.

As for the detailed configuration of the first filter unit F1 and the second filter unit F2, any means known in the art can be applied, so a description of the detailed configuration will be omitted.

Meanwhile, the laundry dryer 1 according to the present invention may further include a water supply unit 80 having an internal water supply unit 81 and an external water supply unit 82 and a steam unit 90 to generate steam by receiving water from the water supply unit 80.

The steam unit 90 may be provided to generate steam by receiving fresh water instead of condensed water. The steam unit 90 may be provided to generate steam by heating water, using ultrasonic waves, or vaporizing.

The steam unit 90 may be controlled to supply steam to the inside of the drum body 21 by receiving water from the internal water supply unit 81 as well as the external water supply unit 82 as needed.

The external water supply unit 82 may include a direct water valve 82*a* adjacent to the rear panel 13 or fixed to the rear panel 13, and a direct water pipe 82*b* to supply the water delivered from the direct water valve 82*a* to the steam unit 90.

The direct water valve 82*a* may be provided to be coupled to an external water supply source. For example, the direct water valve 82*a* may be coupled to a water supply pipe (not shown) extending to the rear surface of the cabinet. Accordingly, the steam unit 90 may be configured to receive water directly through the direct water valve 82*a*.

Therefore, even if the internal water supply unit 81 is omitted or water is not stored in the internal water supply unit 81, the steam unit 90 can receive water for steam generation through the direct water valve 82*a* when necessary.

The direct water valve 82*a* may be directly controlled by a steam control unit 100.

The steam control unit 100 may be installed on the control panel 117, but may be provided as a separate control panel to prevent overloading of the control panel 117 and not increase manufacturing cost, as shown in FIG. 1.

In this case, the steam control unit 100 may be provided adjacent to the steam unit 90. The steam control unit 100 may be provided on the side panel 14 on which the steam unit 90 is installed to reduce the length of a control line or the like connected to the steam unit 90.

On the other hand, the steam unit 90 may be preferably installed adjacent to the direct water valve 82*a*. Accordingly, it is possible to prevent unnecessary residual water from remaining in the direct water pipe 82*b*, and water can be immediately supplied when necessary.

Meanwhile, the internal water supply unit 81 may be configured to include a storage tank 810 to store water, a supply pump 820 to receive water from the storage tank 810 and to deliver water to the steam unit 90 and a tank housing 830 to provide spaces for accommodating the storage tank 810 and the supply pump 820.

A tank withdrawal hole 131 may be formed in an area of the upper panel 13 corresponding to the portion where the storage tank 810 is installed in the tank housing 830.

Since the storage tank 810 is smaller in volume than the water storage tank 72 of the water storage unit 70, it may be easily drawn out. Accordingly, the storage tank 810 may be provided to be withdrawn from the upper panel 13 upward. As a result, since the storage tank 810 and the water storage unit 70 are drawn in different directions from each other, a user can be less likely to get confused.

The upper panel 13 may be provided with a withdrawal cover 132 provided to shield the tank withdrawal hole 131 to prevent the storage tank 810 from being arbitrarily withdrawn.

The withdrawal cover 132 may include a panel coupling unit 133 provided to be coupled to the outer circumferential surface of the tank withdrawal hole 131. The panel coupling unit 133 may be provided extending from one side of the withdrawal cover 132 so as to rotatably couple the withdrawal cover 132 to the upper panel 13. The panel coupling unit 133 and the upper panel 13 may be coupled and provided in a hinge coupling manner.

On the other hand, the withdrawal cover 132 may be provided with a panel handle 134 on the surface that can be gripped by a user, and the panel handle 134 may be composed of a groove formed concave toward the lower portion of the withdrawal cover 132.

Figure 3:
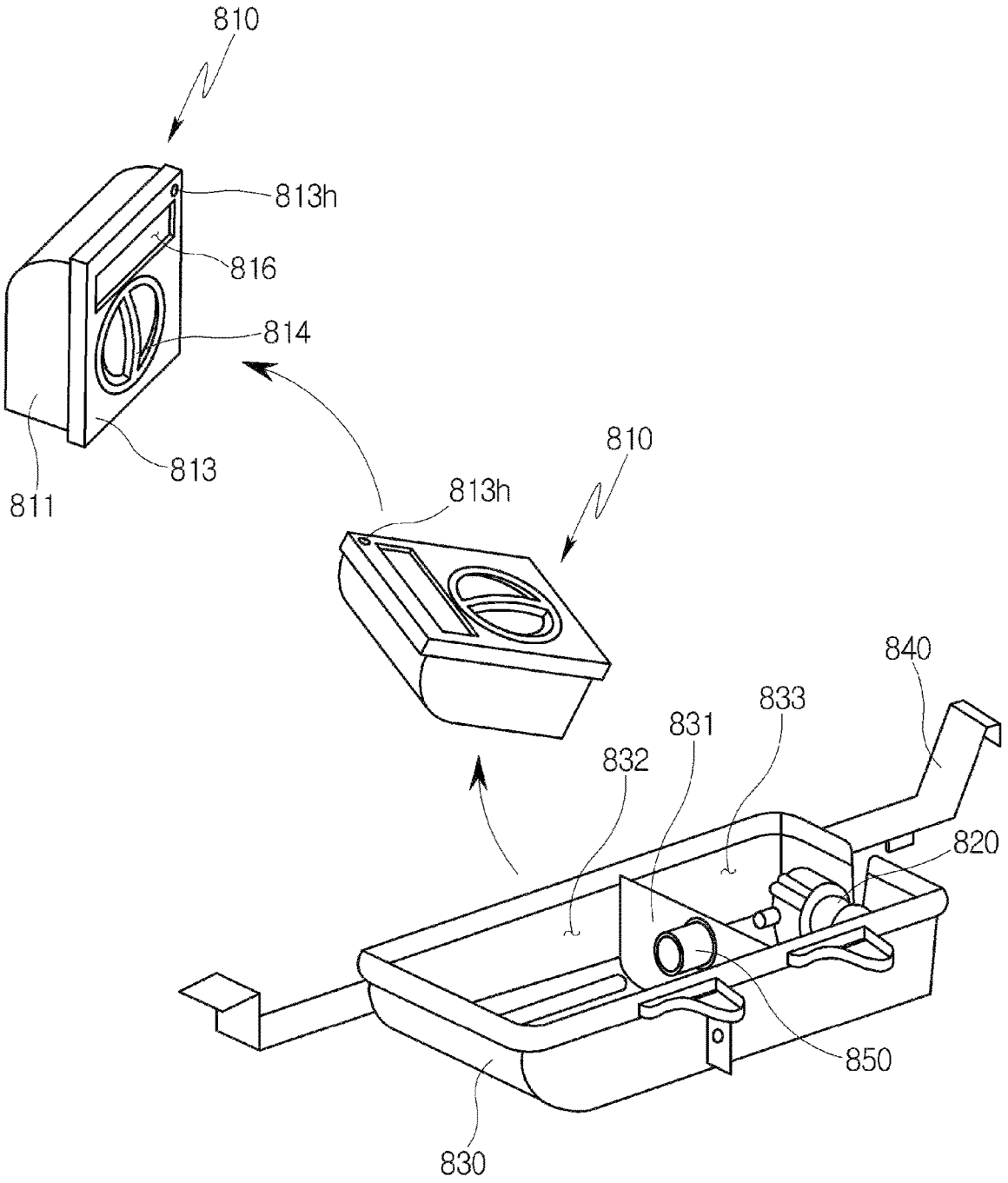
FIG. 3 is a schematic perspective view showing a state in which a storage tank is separated from a tank housing in a laundry dryer according to the present invention.

As shown in FIG. 3, the tank housing 830 may accommodate both a storage tank 810 and a supply pump 820 supplying the water stored in the storage tank 810.

Thus, the tank housing 830 may be divided into a tank receiving unit 832 accommodating the storage tank 810 and a pump receiving unit 833 accommodating the supply pump 820, and the tank receiving unit 832 and the pump receiving unit 833 may be divided using a partition wall 831.

Even if water leaks from the storage tank 810 through the partition wall 831, the leaked water can be blocked from moving to the pump receiving unit 833 in which the supply pump 820 driven by electricity is accommodated, and the accident due to a short circuit and the failure of the supply pump 820 can be prevented.

The partition wall 831 may be configured to extend through the connection pipe 850 connecting the supply unit 817 of the storage tank 810 and the supply pump 820.

The tank housing 830 may be fixed and supported inside the laundry dryer through a support bar 840. One end and the other end of the support bar 840 have a structure that can be fixed to a frame and the internal structure of the laundry dryer or to the cabinet 10.

In addition, one side of the tank housing 830 may be coupled between the one end and the other end of the support bar 840.

Meanwhile, a floater sensor SF, which will be described later, may be fixed to the other side of the tank housing 830. The floater sensor SF may measure the water level inside the storage tank 810 and transmit the sensed water level to the above-described main control unit, and the main control unit may notify a user of a water replenishment alarm through a display unit 119.

When a user opens the withdrawal cover 132 described above in order to replenish water, the storage tank 810 may be exposed to an outside.

In this case, a user can separate the storage tank 810 from the tank housing 830 by simply griping and pulling a handle unit 816 formed on the front upper side surface of the storage tank 810 (in a direction toward the front panel of the cabinet) based on the state in which the storage tank 810 is accommodated in the tank housing 830 (in a flat state).

For easy separation of the storage tank 810, as shown in FIG. 3, the front lower portion of the storage tank 810 may be formed as a convex downward curved surface having a predetermined curvature, and the curved surface corresponding to the curved surface of the storage tank 810 may be formed on the tank housing 830.

After the storage tank 810 is detached, when a user grips the handle unit 816 and moves to a position for replenishing water, the handle unit 816 of the storage tank 810, as shown at the top of FIG. 3, may be in the upward direction. That is, it becomes a standing state by rotating 90 degrees based on the state in which the storage tank 810 is accommodated in the tank housing 830.

On the other hand, a user can open a water supply cap 814 in a state in which the storage tank 810 is laid down in the same manner as the state accommodated in the tank housing 830 and supply water to the internal storage space S of the storage tank 810, and then, close the water supply cap 814 again and complete water replenishment.

The coupling of the storage tank 810 may be performed in the reverse order of the separation process described above.

Figure 4:
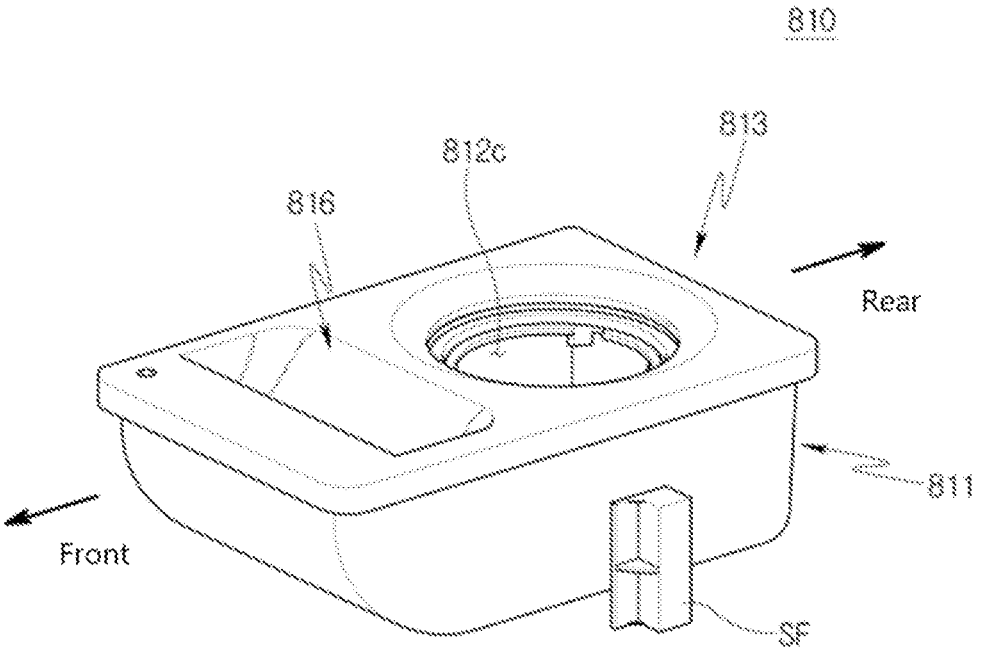
FIG. 4 is a perspective view of a storage tank of the laundry dryer according to the present invention.
Figure 5:
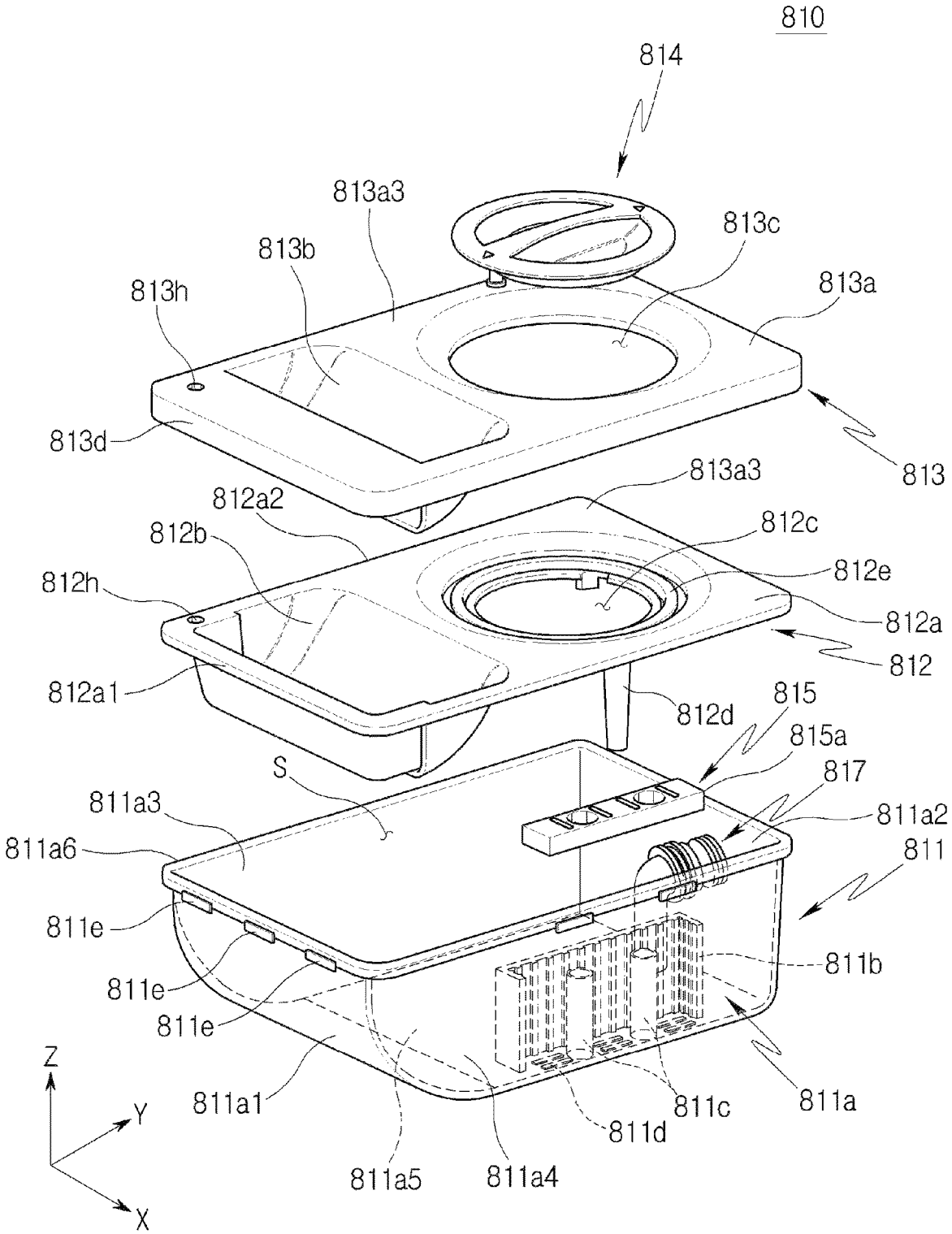
FIG. 5 is an exploded perspective view of FIG. 4.

FIG. 4 is a perspective view of a storage tank 810 of the laundry dryer according to the present invention and FIG. 5 is an exploded perspective view of FIG. 4.

Hereinafter, a detailed configuration of the storage tank 810 will be described with reference to FIGS. 4 and 5.

As described above, the storage tank 810 may store water to be supplied to the steam unit 90 in an airtight manner.

The storage tank 810 may include a tank body 811 having a storage space S formed therein and a tank cover 812 coupled to the open upper side surface of the tank body 811.

The tank body 811 may be configured to include a main body portion 811*a* in a box shape having an open upper side surface to store water therein, and a closed front surface 811*a*1, rear surface 811*a*2, first side surface 811*a*3, second side surface 811*a*4 and lower side surface 811*a*5. The tank body 811 may be manufactured by a plastic injection method in consideration of sealing properties, processability and light weight of the storage space S.

As described above, the front surface 811*a*1 of the main body portion 811*a* may be formed to have a convex downward curved surface with a predetermined curvature in order to easily separate the storage tank 810 from the tank housing 830. The first side surface 811*a*3, the second side surface 811*a*4 and the rear surface 811*a*2 may be formed in a simple planar structure.

A floater 815 may be placed at a position adjacent to either the first side surface 811*a*3 or the second side surface 811*a*4 in the storage tank 810 to measure the level of stored water.

FIG. 5 illustrates an embodiment in which the floater 815 is placed in a position adjacent to the second side surface 811*a*4, but the present invention is not limited thereto. However, for the purpose of convenience, the following description will be made based on an embodiment in which the floater 815 is placed at a position adjacent to the second side surface 811*a*4.

The floater 815 may include a body portion 815*a* made of a material having a lower density than water so that the position in the vertical direction can be moved according to the water level.

As shown, since the tank body 811 has a height (a height in Z direction) is significantly shorter than a length (a length in Y direction) or a width (a width in X direction) based on the state accommodated in the tank housing 830, it is preferable that the floater 815 for measuring the water level is configured to have the height significantly shorter than the length or width.

A magnet M may be embedded inside the center side of the floater 815 so that the water level can be measured in a manner that detects changes in magnetic force or magnetism.

Meanwhile, as described above, the floater sensor SF for detecting a change in position of the magnet M provided in the floater 815 may be attached on the other side of the tank housing 830.

Since any means capable of detecting a change in magnetic force or magnetism is applicable as the floater sensor SF, a detailed description of the configuration will be omitted.

At a position adjacent to the second side surface 811*a*4 of the tank body 811 in which the floater 815 is disposed, a floater case 811*b* and a guide bar 811*c* may be formed as a means for preventing separation of the floater 815 and guiding the movement in the vertical direction (Z direction).

The floater case 811*b* may have a U-shape, as shown, and be configured to have a shape protruding from the lower side surface 811*a*5 of the main body portion 811*a* of the tank body 811. It may be formed and attached separately from the main body portion 811*a* or injection molded integrally with the main body portion 811*a*.

The U-shaped floater case 811*b* and the second side surface 811*a*4 of the tank body 811 together may guide the movement of the floater 815 in the vertical direction (Z direction) in a manner that surrounds the outer surface of the floater 815 and form a space that prevents the floater 815 from being separated.

On the other hand, the floater case 811*b* may be spaced apart from the second side surface 811*a*4 of the tank body 811 at a predetermined interval, so that the accommodation space defined by the floater case 811*b* and the second side surface 811*a*4 of the tank body 811 can communicate with the outer space of the floater case 811*b*.

In addition, a plurality of reinforcing ribs extending linearly in the vertical direction (Z direction) may be formed on the inner surface of the floater case 811*b* toward the floater 815, so that the frictional force can be reduced by minimizing the contact area with the floater 815, while reinforcing the rigidity of the floater case 811*b*.

In addition, a plurality of the bottom ribs 811*d* may be further installed on the lower side surface 811*a*5 of the tank body 811 inside the space defined by the floater case 811*b* and the second side surface 811*a*4 of the tank body 811, so that the contact area with the floater 815 can be minimized and the lowermost position of the floater 815 can be defined.

The highest position of the floater 815 can be defined by the stopper 812*d* formed on the tank cover 812 to be described later.

On the other hand, the guide bar 811*c* may guide the movement of the floater 815 together with the floater case 811*b*, and, like the floater case 811*b*, be formed and attached separately from the main body portion 811*a* or integrally injection molded with the main body portion 811*a* of the tank body 811.

Specifically, as shown, it is configured to as a pair of pillars, preferably cylinders, extending upwardly (Z direction) from the lower side surface 811*a*5 of the tank body 811.

The guide bar 811*c* composed of a pair of cylinders may be inserted into a pair of through holes formed in the floater 815 to guide the movement of the floater 815 and to prevent the departure of the floater 815.

On the other hand, a supply unit 817 may be installed on the rear surface 811*a*2 of the main body portion 811*a* of the tank body 811.

The supply unit 817 may deliver the water stored in the storage space S of the tank body 811 to the outside of the tank body 811, and include a check valve penetrating the rear surface 811*a*2 of the tank body 811 and a water supply pipe having a shape that is bent in an L-shape toward the lower side surface 811*a*5 of the main body portion 811*a* of the tank body 811 from the check valve.

The check valve may be connected in a fitting manner with the connection pipe 850 of the tank housing 830 described above, and regulate the internal flow path so that water is supplied from the water supply pipe to the connection pipe 850 only when connected to the connection pipe 850.

As for the configuration of the check valve and the water supply pipe, a means already known in the art can be applied, and a detailed description of the configuration will be omitted.

The tank cover 812 may be coupled to the open upper side surface of the tank body 811 and cover the upper side surface of the tank body 811 to form a storage space S therein together with the tank body 811.

As shown in FIG. 5, the tank cover 812 may have a rectangular flat plate 812*a* having an approximately uniform thickness, and a first concave surface 812*b* formed close to the front edge 812*a*1 of the flat plate 812*a*.

As described, the present invention is directed to preventing the water leakage between the tank body 811 and the tank cover 812.

Figure 7:
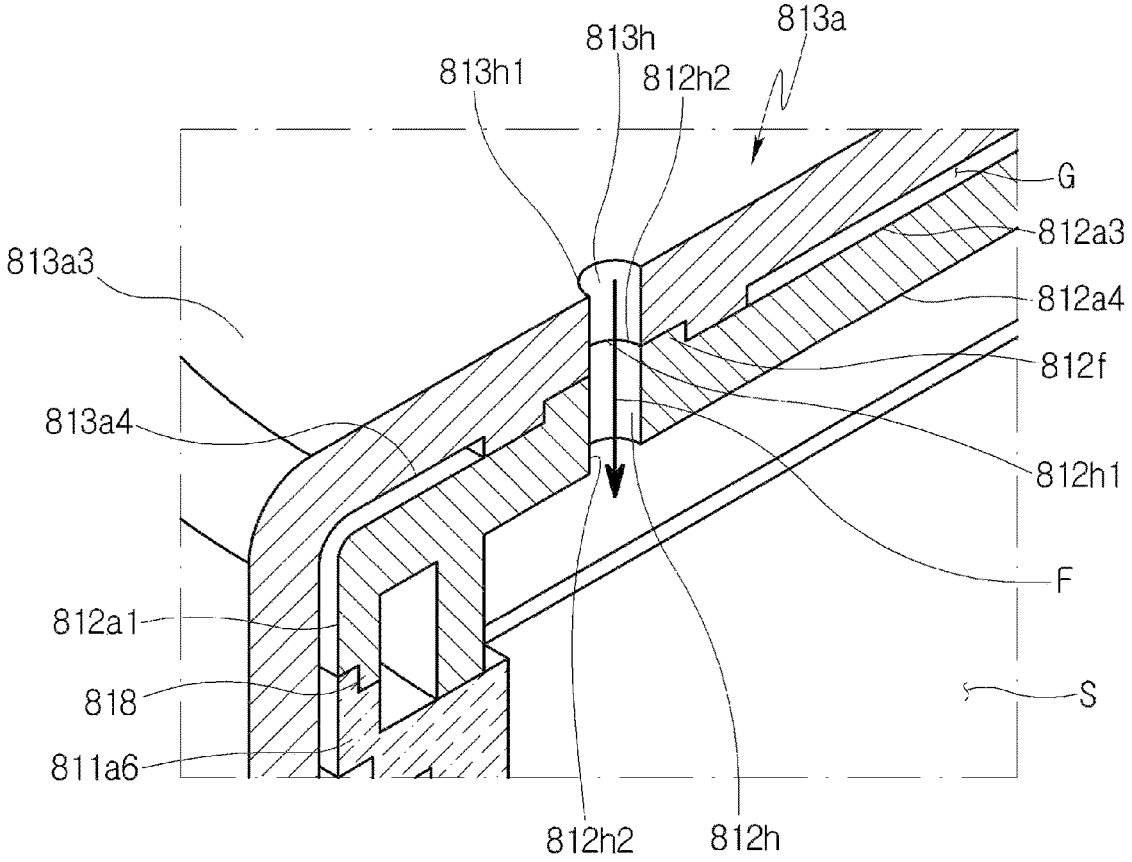
FIG. 7 is a cross-sectional perspective view of FIG. 6.

In order to achieve the prevent the water leakage, the circumferential surface including a front edge 812*a*1, side edge 812*a*2 and rear edge of the tank cover 812 and the upper end portion 811*a*6 of the tank body 811 may be coupled to each other in a fusion bonding to form a fusion portion 818 (See FIG. 7).

In this way, since all the contact surfaces of the tank cover 812 and the tank body 811 are combined in a fusion manner, the possibility of water leakage between the tank cover 812 and the tank body 811 is significantly lowered compared to a conventional art.

In order to increase the fusion strength and reduce the possibility of leakage, the upper end portion 811*a*6 of the tank body 811 and the circumferential surface of the tank cover 812 forming the fusion surface may be formed as a stepped surface. (See FIG. 7)

The tank cover 812 can be manufactured by a plastic injection method like the tank body 811 in order to be easily fused with the tank body 811, and the fusion can be made by using any method already known in the art such as thermal fusion, ultrasonic fusion, etc.

The first concave surface 812*b* may be a configuration for forming the handle unit 816 together with a second concave surface 813*b* of a decorative cover 813 to be described later.

The first concave surface 812*b* may be configured as an inclined curved surface that is convex downward so as to have a depth enough to be easily gripped by a user, and has the shape of a curved surface that is entirely blocked.

Meanwhile, a water supply hole 812*c* may be formed between the first concave surface 812*b* and the rear edge.

A water supply cap 814 may be detachably fastened to the water supply hole 812*c*. A user can separate the water supply cap 814 from the water supply hole 812*c* by rotating the water supply cap 814 in the locked state in the release direction. In the state where the water supply cap 814 is separated, water can be replenished.

In the water supply hole 812*c*, a step portion 812*e* extending toward the inside of the tank body 811 may be installed as a structure for fastening the water supply cap 814 to be detachable and improving the sealing performance of the water supply cap 814.

As for the configuration of the detachable structure between the water supply hole 812*c* and the water supply cap 814, a means already known in the art can be applied, and a detailed description of the configuration will be omitted.

Meanwhile, the step portion 812*e* extending toward the inside of the tank body 811 may also act as a means for visually recognizing the maximum storage capacity of the storage tank 810 to a user.

Thus, while a user separates the water supply cap 814 to replenish water, it acts as a means to visually inform the user that water cannot be added any more when the water level reaches the bottom of the step portion 812*e*. A visual means such as a character or a leader line may be further added to the step portion 812*e* as a means for informing the maximum water level and maximum capacity limitation.

On the other hand, a stopper 812*d* for defining the top position of the floater 815 described above may be formed on the lower side surface 812*a*4 of the flat plate 812*a* of the tank cover 812.

As shown, the stopper 812*d* may be configured in a columnar shape protruding and extending toward the upper side surface of the floater 815 from the lower side surface 812*a*4 of the flat plate 812*a* of the tank cover 812.

The column shaped stopper 812*d* may be manufactured separately from the tank cover 812 and attached to the tank cover 812, or may be integrally formed and manufactured during the injection molding of the flat plate 812*a*.

Meanwhile, a second intake hole 812*h* extending through the flat plate 812*a* between the first concave surface 812*b* and the side edge 812*a*2 may be formed at a position close to the front edge 812*a*1 of the tank cover 812.

The second intake hole 812*h* may act as an intake hole for forming an air flow path by communicating the storage space S of the storage tank 810 and an external space together with a first intake hole 813*h* to be described later.

The second intake hole 812*h* may be formed at a position avoiding the above-described fusion portion 818 so as to form an unblocked air flow path.

The detailed configurations of the first intake hole 813*h* and the second intake hole 812*h* will be described later with reference to FIGS. 6 to 10.

On the other hand, the storage tank 810 of the laundry dryer according to the present invention may further include a decorative cover 813 attached to the upper side surface 812*a*3 of the tank cover 812 and to at least partially cover the upper side surface 812*a*3 of the tank cover 812.

As an example, FIGS. 4 and 5 illustrate a decorative cover 813 covering all of the upper side surface 812*a*3 of the tank cover 812, but the present invention is not limited thereto, and the configuration of the decorative cover 813 covering a part of the upper side surface 812*a*3 belongs to the scope of the present invention. For convenience, the following description will be made with respect to the configuration of the decorative cover 813 covering the entire upper side surface 812*a*3 of the tank cover 812.

The decorative cover 813 may be manufactured by injection molding in the same manner as the tank body 811 and the tank cover 812. It may be attached to the upper side surface 812*a*3 of the tank cover 812 to protect the upper side surface 812*a*3 of the tank cover 812 and to improve user convenience by forming the handle unit 816 together with the first concave surface 812*b* of the tank cover 812 described above.

For enhancing such convenience function, a second concave surface 813*b* in the form of a convex downward curved surface at a position corresponding to the above described first concave surface 812*b* may be provided on a flat plate 813*a* of the decorative cover 813.

The second concave surface 813*b* may be formed to have a shape corresponding to the first concave surface 812*b* only partially. Therefore, the second concave surface 813*b* may function as a space in which a finger can enter when a user is gripping it, and the portion between a front edge 813*a*1 of the flat plate 813*a* and the second concave surface 813*b*, as a portion where the concave surface is not formed, may function as a grip unit through which the user's finger can be caught.

The decorative cover 813 may be configured to be detachably fastened to the tank body 811. To this end, the decorative cover 813 may include an edge portion 813*d* extending from the front edge 813*a*1, side edge 813*a*2 and rear edge of the flat plate 813*a* toward the tank body 811.

In addition, a plurality of locking protrusions 811*e* that fits to the edge portion 813*d* of the decorative cover 813 may be formed on the upper end portion 811*a*6 of the tank body 811 that is a position corresponding to the edge portion 813*d* during fastening.

On the other hand, a through hole 813*c* having a shape corresponding to the water supply hole 812*c* of the tank cover 812 may be formed between the second concave surface 813*b* and the rear edge of the flat plate 813*a* and at a position corresponding to the water supply hole 812*c* of the tank cover 812.

In addition, a first intake hole 813*h* extending through the upper surface 813*a*3 may be formed between the second concave surface 813*b* and the front edge 813*a*1 and at a position close to the front edge 813*a*1 of the decorative cover 813.

The first intake hole 813*h* may act as an intake hole for forming an air flow path by communicating the storage space S of the storage tank 810 with an external space, together with the second intake hole 812*h* as described above.

Figure 6:
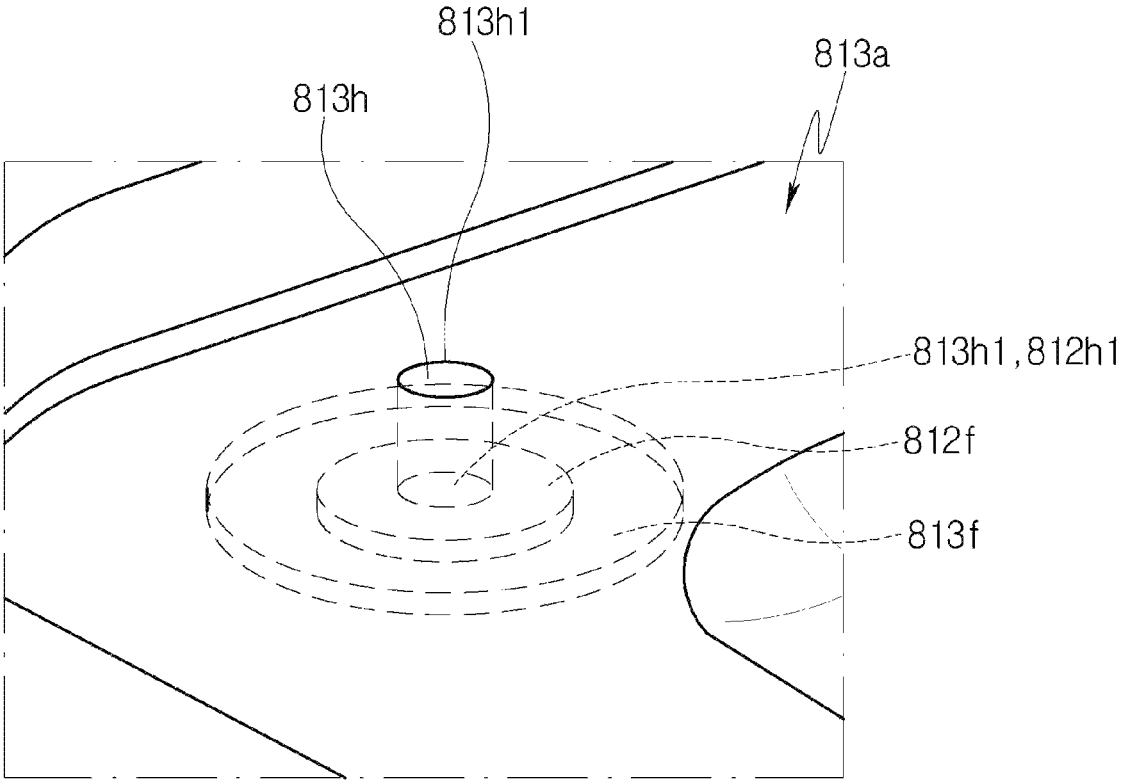
FIG. 6 is a partially enlarged view showing the configuration of an intake hole according to a first embodiment of the present invention.

FIGS. 6 and 7 are the detailed configurations of the intake hole according to a first embodiment.

The first embodiment of an intake hole including a first intake hole 813*h* and a second intake hole 812*h* will be described with reference to FIGS. 6 and 7.

As described above, the present invention is directed to reducing the load of the supply pump 820 and maintaining smooth water supply by maintaining the internal air pressure of the storage tank 810 and an external air pressure the same when the water stored in the storage tank 810 is supplied to the steam unit 90 by using the supply pump 820.

This is achieved by an intake hole including the first intake hole 813*h* provided in the decorative cover 813 and the second intake hole 812*h* provided in the tank cover 812.

That is, a continuous air flow path F that fluidly connects the storage space S and an external space may be formed by using the first intake hole 813*h* extending through the upper side surface 813*a*3 and the lower side surface 813*a*4 of the decorative cover 813, and the second intake hole 812*h* extending through the upper side surface 812*a*3 and the lower side surface 812*a*4 of the tank cover 812. Thus, an external air can be introduced into the storage space S through the first intake hole 813*h* and the second intake hole 812*h* in response to the flow rate of the water supplied to the steam unit 90 during the operation of supply pump 820.

Therefore, even if the water in the storage space S decreases, the internal air pressure of the storage space S is prevented from being lowered, and the internal air pressure of the storage space S and the external air pressure can be maintained equally.

However, the water stored in the storage space S does not limit the formation positions of the first intake hole 813*h* and the second intake hole 812*h*, and there is a possibility of leakage through them.

To prevent leakage, as described above, the first intake hole 813*h* may be formed between the front edge 813*a*1 and the second concave surface 813*b* of the decorative cover 813, and the second intake hole 812*h* may be formed between the first concave surface 812*b* and the side edge 812*a*2 of the tank cover 812 and at a position close to the front edge 812*a*1 of the tank cover 812.

As such, the formation positions of the first intake hole 813*h* and the second intake hole 812*h* may be higher than the highest water level of water stored therein even when the storage tank 810 is accommodated in the tank housing 830, and they may be higher than the highest water level or the second concave surface 813*b* even in a state in which the storage tank 810 is gripped and moved by the user (a standing state). Thus, no water leakage occurs through the first intake hole 813*h* and the second intake hole 812*h* even in the state of in which the storage tank 810 is accommodated and in a standing state.

As described above, since the decorative cover 813 and the tank cover 812 are manufactured by injection molding, the first intake hole 813*h* and the second intake hole 812*h* may be processed as a cylindrical through hole vertically penetrating through the flat plate 813*a* of the decorative cover 813 and a cylindrical through hole vertically penetrating through the flat plate 812*a* of the tank cover 812, respectively, in considering the ease of molding and manufacturing cost.

The first intake hole 813*h* in a cylindrical shape may include a first inlet 813*h*1 and a first outlet 813*h*2 in a circular shape, and the second intake hole 812*h* in a cylindrical shape may include a second inlet 812*h*1 and a second outlet 812*h*2 in a circular shape.

In this case, the first outlet 813*h*2 of the first intake hole 813*h* and the second inlet 812*h*1 of the second intake hole 812*h* may be directly connected to at least partially overlap, so that the air flow path F including the first intake hole 813*h* and the second intake hole 812*h* can be simplified.

FIG. 7 illustrates an embodiment in which the first outlet 813*h*2 of the first intake hole 813*h* and the second inlet 812*h*1 of the second intake hole 812*h* each have the same diameter, and are entirely overlapped, but the present invention is not limited thereto.

For example, the first outlet 813*h*2 of the first intake hole 813*h* and the second inlet 812*h*1 of the second intake hole 812*h* may have different diameters from each other.

In more detail, the diameter of the first outlet 813*h*2 of the first intake hole 813*h* may be smaller than the diameter of the second inlet 812*h*1 of the second intake hole 812*h*. As such, when that the first outlet 813*h*2 is formed to be smaller than the second inlet 812*h*1, the water droplets flowing out through the first intake hole 813*h* and the second intake hole 812*h* due to the fluctuation of the water surface in the storage space S can be minimized.

The splashing of water due to the swaying of the water surface inside the storage tank 810 is mainly occurred in a situation in which water is replenished at the maximum capacity and is held and moved by a user or in a situation in which water is replenished at the maximum capacity, and the user mounds the storage tank 810 on the tank housing 830.

As water splashes occur, water droplets may be leaked to the outside of the storage tank 810 through the first intake hole 813*h* and the second intake hole 812*h*, alternatively, water may be leaked to the gap G between the decorative cover 813 and the tank cover 812.

In order to prevent water from leaking into the gap G between the decorative cover 813 and the tank cover 812, a cylindric-shaped first engaging protrusion 812*f* having a shape surrounding the second inlet 812*h*1 and protruding toward the first outlet 813*h*2 may be formed on the upper side surface 812*a*3 of the tank cover 812, and a ring-shaped second engaging protrusion 813*f* having a shape surrounding the first outlet 813*h*2 and protruding toward the second inlet 812*h*1 on the lower side surface of the decorative cover 813.

In this case, when the decorative cover 813 is attached to the tank cover 812, the first engaging protrusion 812*f* may be inserted into the second engaging protrusion 813*f*, and the outer circumferential surface of the first engaging protrusion 812*f* and the inner circumferential surfaces of the second engaging projections 813*f* may be configured to be in close contact with each other over the circumferential direction.

Since the circumference of the first outlet 813*h*2 of the first intake hole 813*h* and the second inlet 812*h*1 of the second intake hole 812*h*, which are directly connected, may be sealed through the first engaging projection 812*f* and the second engaging protrusion 813*f*, the water leakage due to splashing of water into the gap G formed outside the first engaging protrusion 812*f* and the second engaging protrusion 813*f* may be fundamentally blocked.

Figure 8:
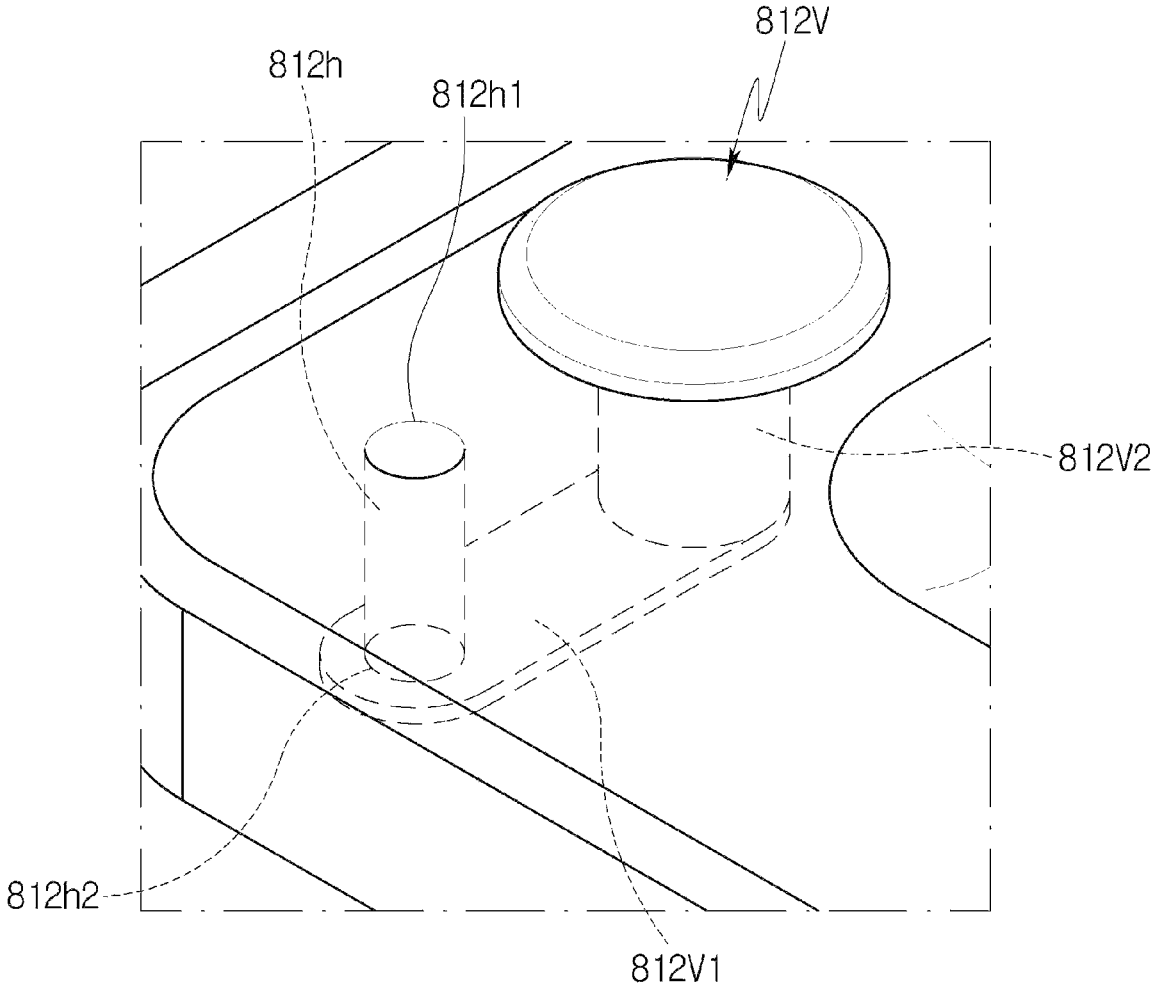
FIG. 8 is a partially enlarged view showing a configuration of an intake hole according to a second embodiment of the present invention.
Figure 9:
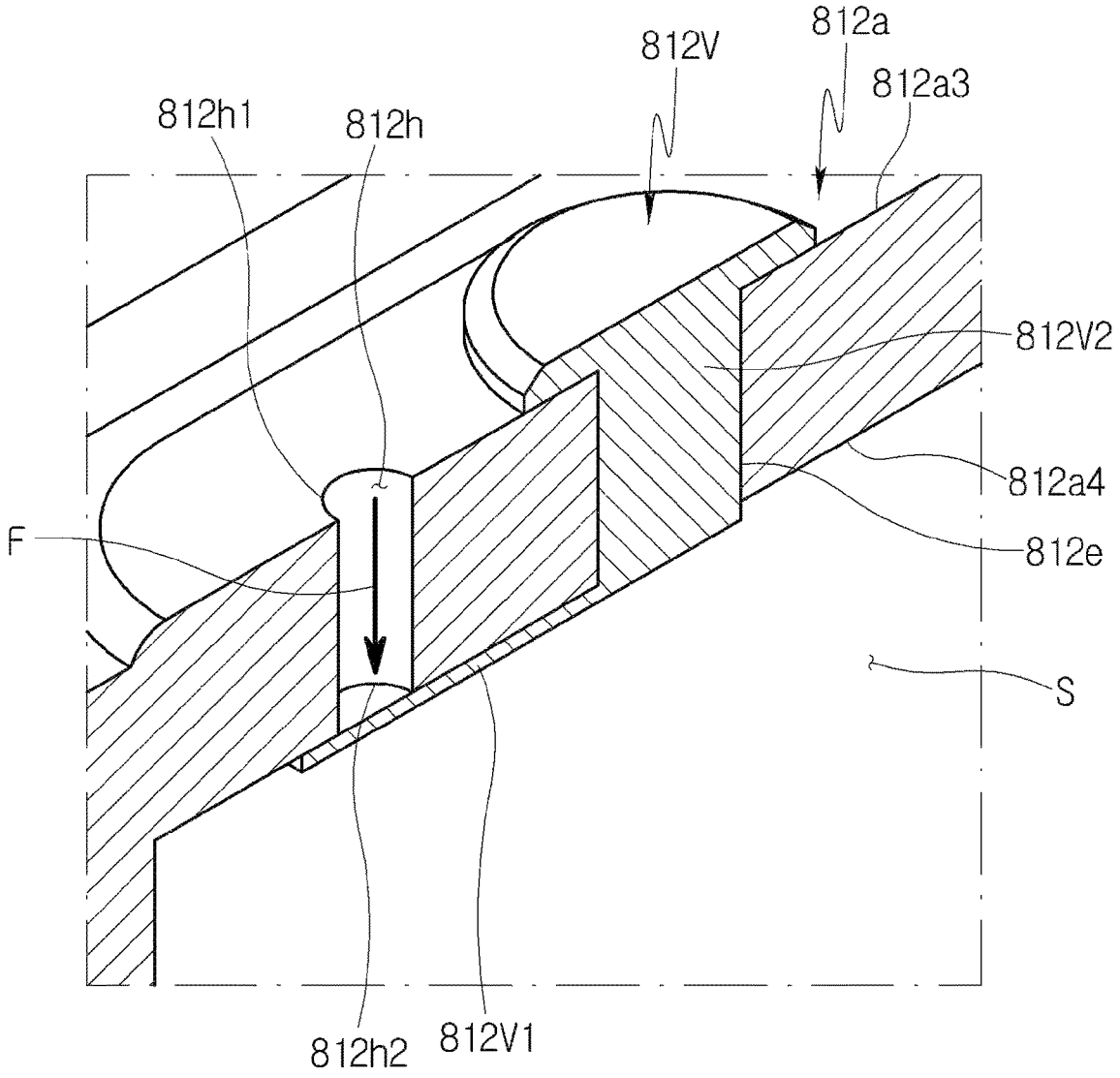
FIG. 9 is a cross-sectional perspective view of FIG. 8.

FIGS. 8 and 9 illustrate the detailed configurations of an intake hole according to a second embodiment.

The second embodiment of the intake hole including the first intake hole 813*h* and the second intake hole 812*h* is described with reference to FIGS. 8 and 9.

The illustrated second embodiment may further include an intake valve 812*v* for opening and closing the second outlet 812*h*2 of the second intake hole 812*h*, unlike the first embodiment.

In more detail, the intake valve 812*v* may include a reed valve body 812*v*1 and a fixing part 812*v*2 that is fixed to the tank body 811 and supports the reed valve body 812*v*1.

In the reed valve body 812*v*1, one end may become a fixed end attached to and supported on the lower side surface 812*a*4 of the tank cover 812 through the fixing part 812*v*2, and the other end may become a free end to open and close the second intake hole 812*h* of the second outlet 812*h*2.

The reed valve body 812*v*1 may have a thin film shape having a predetermined elasticity. When the reed valve body 812*v*1 is installed on the lower side surface 812*a*4 of the tank cover 812, it may have a shape-holding force for maintaining a close contact with the lower side surface 812*a*4 of the tank cover 812 as a whole, so that the one end may block the second outlet 812*h*2 of the second intake hole 812*h*.

Therefore, even if water splash occurs in a situation in which the storage tank 810 is gripped and moved by a user or in a situation in which the storage tank 810 is mounted in the tank housing 830 by the user after refilling water, the leakage of water droplets through the second intake hole 812*h* may be fundamentally blocked by the reed valve body 812*v*1.

On the other hand, after the storage tank 810 is mounted in the tank housing 830, when the supply pump 820 is operated to supply water inside the storage tank 810, the internal air pressure of the storage space S may be lower than the external air pressure. Due to this air pressure difference, the other end of the reed valve body 812*v*1 may be bent downward, and the second outlet 812*h*2 of the second intake hole 812*h* may be opened.

At the same time as the second outlet 812*h*2 is opened, the air flow path F may be opened so that external air can be introduced in response to the water supply amount of the supply pump 820.

The other end of the reed valve body 812*v*1 may be connected to the fixing part 812*v*2 to be fixed to the tank cover 812. The reed valve body 812*v*1 may be manufactured separately and attached to the fixing part 812*v*2, or may be manufactured integrally with the fixing part 812*v*2 as shown.

The tank cover 812 may be provided with a fixing hole 812*e* through which the fixing part 812*v*2 of the intake valve 812*v* extends.

As shown, the fixing part 812*v*2 may include a body portion extending through the fixing hole 812*e*, and a head portion formed at one end of the body portion.

The other end of the body portion may be connected to the other end of the reed valve body 812*v*1. The outer diameter of the body portion of the fixing part 812*v*2 may be formed larger than the inner diameter of the fixing hole 812*e*. Thus, since the body portion remains connected to the reed valve body 812*v*1, the separation of the reed valve body 812*v*1 in a vertical direction can be effectively prevented after it is the fixing hole 812*e*.

On the other hand, although not shown, in the second embodiment, since water leakage into the gap G due to water splashing through the intake valve 812*v* can be fundamentally blocked at the source, the sealing structure such as the first engaging protrusion 812*f* and the second engagement protrusion 813*f* according to the first embodiment may be omitted.

Accordingly, the structures of the tank cover 812 and the decorative cover 813 according to the second embodiment may be further simplified compared to the first embodiment.

Figure 10:
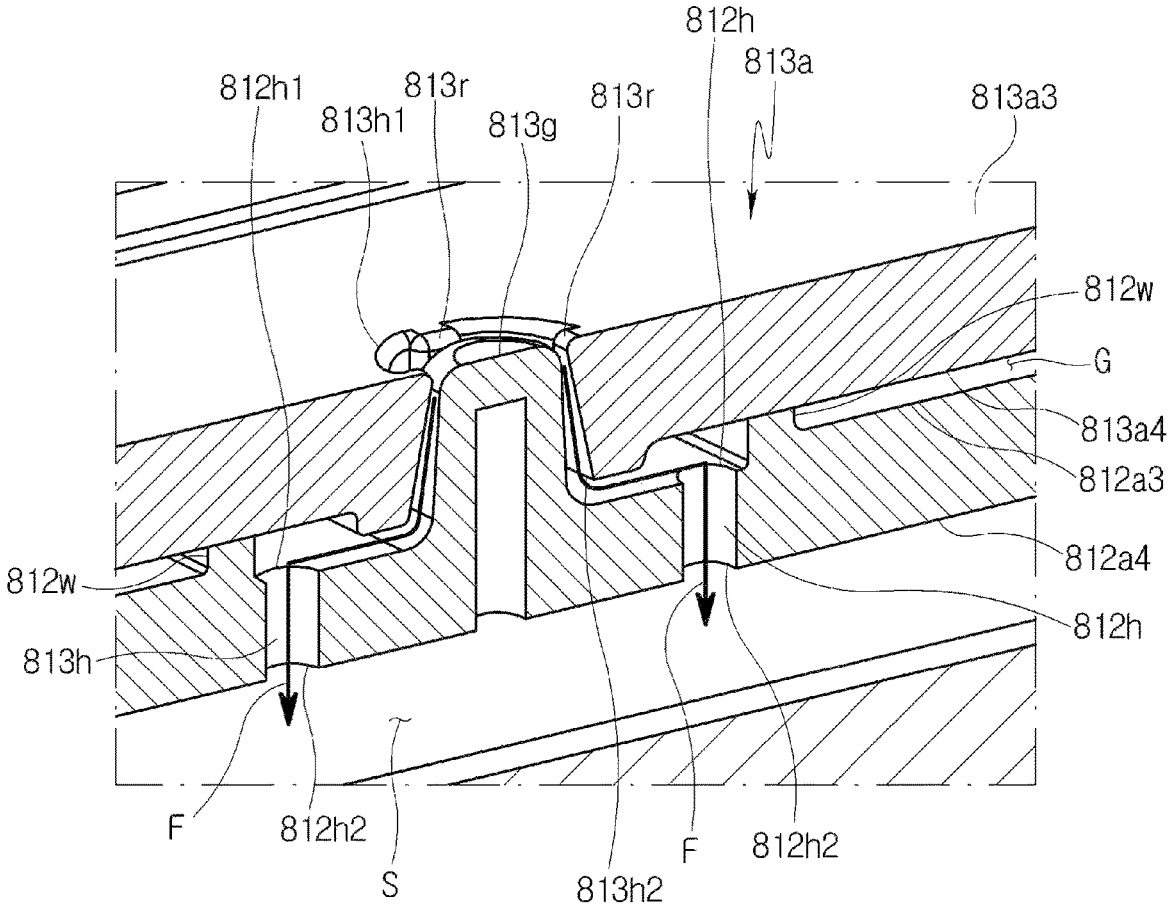
FIG. 10 is a cross-sectional perspective view showing a configuration of an intake hole according to a third embodiment of the present invention.

FIG. 10 shows a detailed configuration of an intake hole according to a third embodiment.

The third embodiment of the intake hole including the first intake hole 813*h* and the second intake hole 812*h* is described with reference to FIG. 10.

In the illustrated third embodiment, unlike the first and second embodiments, the first outlet 813*h*2 of the first intake hole 813*h* and the second inlet 812*h*1 of the second intake hole 812*h* may be formed to be spaced apart from each other so that overlapping portions do not occur.

That is, as shown, the direction of the air flow path F can be changed between the first outlet 813*h*2 of the first intake hole 813*h* and the second inlet 812*h*1 of the second intake hole 812*h*.

With this configuration, the air that has passed through the first inlet 813*h*1 of the first intake hole 813*h* may pass through the first outlet 813*h*2, and the flow path may be switched at least once, and then, it may enter into the second inlet 812*h*1 of the second intake hole 812*h*. However, on the contrary, due to the occurrence of water splashing described above, the water droplets passing through the second outlet 812*h*2 and the second inlet 812*h*1 of the second intake hole 812*h* may not reach the first outlet 813*h*2 of the second intake hole 812*h* and collides with the lower side surface 813*a*4 of the decorative cover 813.

Accordingly, it can significantly reduce the possibility that the water droplets generated by the occurrence of water splashes pass through the first intake hole 813*h* and leak to an outside.

Meanwhile, an insertion boss 813*g* protruding from the upper side surface 812*a*3 of the tank cover 812 and to be inserted into the first intake hole 813*h* may be formed on the upper side surface 812*a*3 of the tank cover 812.

The insertion boss 813*g* may be integrally formed on the upper side surface 812*a*3 of the tank cover 812 as shown, and the outer shape may be configured to have a cylindrical shape corresponding to the shape of the inner circumferential surface of the first intake hole 813*h*.

Further, a plurality of guide ribs 813*r* protruding toward the inside of the second intake hole 812*h* may be formed on the inner circumferential surface of the first intake hole 813*h*.

The plurality of guide ribs 813*r* may be processed to have a shape extending linearly from the first inlet 813*h*1 of the first intake hole 813*h* to the second outlet 812*h*2 in consideration of formability.

The configuration of the insertion boss 813*g* and the guide rib 813*r* can additionally block a path through which water droplets generated by the above-described splashing of water can pass.

Therefore, the likelihood that water droplets generated by the occurrence of water splash pass through the first intake hole 813*h* and leak to the outside can be further reduced with the blocking structure in which the insertion boss 813*g* and the guide rib 813*r* are formed.

Meanwhile, as shown, the first inlet 813*h*1 and the first outlet 813*h*2 of the first intake hole 813*h* may have different diameters to each other, preferably the first inlet 813*h*1 may have a smaller diameter than that of the first outlet 813*h*2.

In this case, the first intake hole 813*h* may be configured to have a truncated cone shape in which a cross-sectional area gradually expands while proceeding from the first inlet 813*h*1 to the first outlet 813*h*2.

This can make a margin so that the insertion boss 813*g* can easily enter into the first outlet 813*h*2 of the first intake hole 813*h* when the decorative cover 813 is fastened.

In this case, the upper side surface 812*a*3 of the tank cover 812 may be further provided with a blocking wall portion 812*w* extending from the upper side surface 812*a*3 of the tank cover 812 to the lower side surface of the decorative cover 813 so as to surround the second inlet 812*h*1 of the second intake hole 812*h* and the insertion boss 813*g*.

As shown, when the decorative cover 813 is fastened, the upper surface of the blocking wall portion 812*w* may be in close contact with the lower side surface of the decorative cover 813, so that the inner space of the blocking wall portion 812*w* may be completely blocked from the outside of the blocking wall portion 812*w*

By the configuration of the blocking wall portion 812*w*, the water droplets generated by water splashing can pass through the second inlet 812*h*1 of the second intake hole 812*h* and be blocked to leak to the gap between the decorative cover 813 and the tank cover 812.

In the other hand, in the third embodiment shown in FIG. 10, the blocking wall portion 812*w* is illustrated to be integrally formed on the upper side surface 812*a*3 of the tank cover 812, but this is only exemplary, and conversely, another embodiment in which the blocking wall portion 812*w* is formed on the lower side surface of the decorative cover 813 will also naturally belong to the scope of the present invention.

As such, it will be appreciated that the technical configuration of the present invention described above can be implemented in other specific forms without changing the technical spirit or essential features of the present invention by those skilled in the art.

Therefore, the embodiments described above are to be understood as illustrative and non-limiting in all respects, and the scope of the present invention is indicated by the claims to be described later rather than the detailed description described above, and the meaning and scope of the claims and all changes or modified forms derived from the equivalent concept should be interpreted as being included in the scope of the present invention.

| Explanation of reference numerals | |
|---|---|
| 1: laundry dryer | 20: drum |
| 30: driving unit | 40: heat exchange unit |
| 50: driving unit | 60: water collecting unit |
| 70: water storage unit | 80: water supply unit |
| 81: internal water supply unit | 810: storage tank |
| 811: tank body | 812: tank cover |
| 813: decorative cover | 816: handle unit |
| 813h: first intake hole | 812h: second intake hole |
| 820: supply pump | 830: tank housing |
| 90: steam unit | 100: steam control unit |

What is claimed is:

1. A laundry dryer comprising:

a cabinet defining an outer body of the laundry dryer;

a drum that is rotatably disposed inside the cabinet and that is configured to receive hot air and steam;

a steam unit that is disposed inside the cabinet and that is configured to generate the steam;

a storage tank comprising:

a tank body that is configured to detachably couple to an inside of the cabinet and that defines a storage space for receiving water to be supplied to the steam unit, a tank cover coupled to an upper side of the tank body, and a decorative cover that covers a portion of an upper surface of the tank cover; and a tank housing that is disposed inside the cabinet and that is configured to accommodate the storage tank, wherein an intake hole is defined at a front upper surface of the storage tank and provides, based on the storage tank being accommodated in the tank housing, an air flow path extending through the tank cover and the decorative cover between the storage space and an external space of the storage tank.

2. The laundry dryer of claim 1, further comprising a supply pump that is disposed between the steam unit and the storage tank and that is configured to transfer the water stored in the storage tank to the steam unit, wherein the supply pump is configured to suction air from the external space of the storage tank into the storage space through the intake hole.

3. The laundry dryer of claim 2, wherein the intake hole includes (i) a first intake hole extending through the decorative cover and (ii) a second intake hole extending through the tank cover.

4. The laundry dryer of claim 3, wherein the storage tank further includes a handle unit that defines (i) a first concave surface having a concave shape from the tank cover toward the storage space and (ii) a second concave surface having a concave shape from the decorative cover toward the first concave surface, and wherein the first concave surface is defined adjacent to a front edge of the tank cover and the second concave surface is defined adjacent to a front edge of the decorative cover.

5. The laundry dryer of claim 4, wherein the first intake hole is defined between the front edge of the decorative cover and the second concave surface, and the second intake hole is defined between the first concave surface and a side edge of the tank cover and adjacent to the front edge of the tank cover.

6. The laundry dryer of claim 5, wherein the storage tank is configured to detach from the tank housing by a force applied to the handle unit, and wherein the first intake hole and the second intake hole are positioned higher than the second concave surface in a direction of gravity based on the storage tank being separated from the tank housing by the force applied to the handle unit.

7. The laundry dryer of claim 6, wherein the front edge of the tank cover and the side edge of the tank cover are fused to an upper end of the tank body to provide a fused portion, and wherein the second intake hole is not a part of the fused portion.

8. The laundry dryer of claim 6, wherein the first intake hole includes a first inlet defined at an upper surface of the decorative cover and a first outlet defined at a lower surface of the decorative cover, wherein the second intake hole includes a second inlet defined at the upper surface of the tank cover and a second outlet defined at a lower surface of the tank cover, and wherein the first outlet and the second inlet are connected to overlap at least partially.

9. The laundry dryer of claim 8, wherein all portions of the first outlet and all portions the second inlet overlap.

10. The laundry dryer of claim 9, wherein each of the first outlet and the second inlet has a circular shape with the same diameter.

11. The laundry dryer of claim 9, wherein each of the first outlet and the second inlet has a circular shape and a diameter of the first outlet is less than a diameter of the second inlet.

12. The laundry dryer of claim 8, wherein the tank cover includes a cylindrical-shaped first engaging protrusion that surrounds the second inlet and that protrudes from the upper surface of the tank cover toward the first outlet, wherein the decorative cover includes a ring-shaped second engaging protrusion that surrounds the first outlet and that protrudes from the lower surface of the decorative cover toward the second inlet, and wherein the cylindrical-shaped first engaging protrusion is configured to, based on the decorative cover being attached to the tank cover, insert into an inside of the ring-shaped second engaging protrusion.

13. The laundry dryer of claim 12, wherein an outer circumferential surface of the cylindrical-shaped first engaging protrusion and an inner circumferential surface of the ring-shaped second engaging protrusion are adjacent to each other over a circumferential direction.

14. The laundry dryer of claim 8, wherein the storage tank further includes an intake valve configured to open and close the second outlet of the second intake hole.

15. The laundry dryer of claim 14, wherein the intake valve includes a reed valve body having a first end that is fixedly attached to the lower surface of the tank cover and a second end that is configured to open and close the second outlet, and wherein the second end of the reed valve body is configured to, based on the supply pump operating, separate from the first outlet by an air pressure difference between the storage space and the external space of the storage tank.

16. The laundry dryer of claim 6, wherein the first intake hole includes a first inlet defined at an upper surface of the decorative cover and a first outlet defined at a lower surface of the decorative cover, wherein the second intake hole includes a second inlet defined at the upper surface of the tank cover and a second outlet defined at a lower surface of the tank cover, and wherein the first outlet of the first intake hole and the second inlet of the second intake hole do not overlap each other.

17. The laundry dryer of claim 16, wherein the tank cover further includes an insertion boss protruding from the upper surface of the tank cover to be inserted into the first intake hole, and wherein the decorative cover further includes a plurality of guide ribs protruding from an inner circumferential surface of the first intake hole toward inside of the first intake hole and extending from the first inlet to the first outlet.

18. The laundry dryer of claim 17, wherein each of the first inlet and the first outlet has a circular shape and a diameter of the first inlet is less than a diameter of the first outlet.

19. The laundry dryer of claim 18, wherein the inner circumferential surface of the first intake hole has a truncated cone shape in which a cross-sectional area gradually expands from the first inlet to the first outlet.

20. The laundry dryer of claim 19, wherein the tank cover further includes a blocking wall portion extending from the upper surface of the tank cover toward the lower surface of the decorative cover to surround the second inlet of the second intake hole and the insertion boss, and wherein an upper surface of the blocking wall portion is adjacent to the lower surface of the decorative cover.

* * * * *